US005513588A

United States Patent [19]

Kojima et al.

[11] Patent Number: 5,513,588

[45] Date of Patent: May 7, 1996

[54] OVERLOCK SEWING MACHINE AND THREAD CHAIN BACK-TACKER THEREFOR

[75] Inventors: Toshihiko Kojima; Makoto Uchida, both of Toyonaka, Japan

[73] Assignee: Yamato Mishin Seizo Kabushiki Kaisha, Osaka, Japan

[21] Appl. No.: 336,244

[22] Filed: Nov. 7, 1994

Related U.S. Application Data

[63] Continuation-in-part of Ser. No. 152,376, Nov. 16, 1993, abandoned.

[30] Foreign Application Priority Data

Nov. 16, 1992 [JP] Japan ..... 4-305555

[51] Int. Cl.[6] ..... D05B 1/12; D05B 29/06; D05B 57/08; D05B 65/06

[52] U.S. Cl. ..... 112/197; 112/235; 112/288

[58] Field of Search ..... 112/235, 240, 112/260, DIG. 1, DIG. 2, DIG. 3, 197, 165, 287, 288, 285

[56] References Cited

U.S. PATENT DOCUMENTS

| | | | |
|---|---|---|---|
| 1,198,780 | 9/1916 | Seymour | 112/235 |
| 3,749,040 | 7/1973 | Jurgens | 112/287 |
| 3,922,980 | 12/1975 | Fulp | 112/197 |
| 4,381,722 | 5/1983 | Takeuchi et al. | 112/235 |
| 4,763,590 | 8/1988 | Kojima et al. | 112/287 |
| 4,934,293 | 6/1990 | Yokota et al. | 112/288 |

FOREIGN PATENT DOCUMENTS

| | | | |
|---|---|---|---|
| 1045797 | 3/1986 | Japan | 112/235 |
| 2168987 | 6/1990 | Japan | 112/287 |
| 3155894 | 7/1991 | Japan | 112/235 |

*Primary Examiner*—Ismael Izaguirre

*Attorney, Agent, or Firm*—Fay, Sharpe, Beall, Fagan, Minnich & McKee

[57] ABSTRACT

A thread chain back-tacker for an overlock sewing machine eliminates defective back-tacking. The back-tacker includes a thread chain cutter, an adjuster for adjusting the length of free thread chain after the end of back-tacking, a presser foot, an air nozzle, a thread drawing nozzle, a thread clamp cylinder, a nozzle swing cylinder, a nozzle pulling cylinder, a cylinder retainer coupling the nozzle swing cylinder and nozzle pulling cylinder together, a position adjuster bolt provided on the cylinder retainer for adjusting a stop position of the thread drawing nozzle, a speed setting/releasing unit, a venturi unit, an air breaking valve, and a solenoid for on-off operating the air breaking valve. The presser foot includes a presser body, a presser foot chain shield secured to the rear end of the presser body, and a presser foot stitch tongue secured to a central portion of the presser body. The presser foot stitch tongue has its back surface provided with a groove for guiding a thread chain and also has a top guide for guiding the thread chain into the groove. Not only is it possible to eliminate curling of the cloth end at the start of back-tacking and projection of the thread chain, but also it is possible to eliminate loosening of upper looper yarn. Satisfactory back-tacking results thus are obtainable, and needle breakage or the like is prevented.

3 Claims, 9 Drawing Sheets

OVERLOCK SEWING MACHINE AND THREAD CHAIN BACK-TACKER THEREFOR

This is a continuation-in-part of application Ser. No. 08/152,376, filed Nov. 16, 1993, now abandoned.

BACKGROUND OF THE INVENTION

1. Field of the Invention

This invention relates to thread chain back-tackers for overlock sewing machines and, more particularly, to a thread chain back-tacker for an overlock sewing machine which can eliminate defective back-tacking of surplus thread chain having been cut from a cloth at a former position, to the start end of a cloth at a subsequent position, permitting satisfactory back-tacking at all times.

2. Description of the Related Art

To prevent loosening of the tacking start portion of a cloth, various back-tacking machines have been proposed in which a free thread chain surplus separated from the cloth at a former position thereof is back-tacked to a tacking start seam of the cloth at a subsequent position.

In the prior art thread chain back-tacker, the cloth end curls at the beginning of the back-tacking. In avoiding this drawback, the thread chain is caused to project from the cloth end at the start of back-tacking or loosening of upper looper yarn tension, thus resulting in defective back-tacking; that is, satisfactory results of back-tacking fail to be obtained.

SUMMARY OF THE INVENTION

An object of the present invention is to provide a thread chain back-tacker for an overlock sewing machine which can solve the above problems inherent in the prior art and eliminate defective back-tacking to permit satisfactory back-tacking results to be obtained, by guiding the thread chain with the back surface of a presser foot for back-tacking to the cloth at a subsequent position thereof.

To attain the above object of the invention, there is provided a thread chain back-tacker for an overlock sewing machine for back-tacking thread chain to cloth at a subsequent position, which comprises a thread chain cutter provided on the overlock sewing machine, an adjuster for adjusting the length of the thread chain surplus after the end of back-tacking, a presser foot for pressing the cloth being tacked, a front air nozzle disposed above the presser foot for determining the back-tacking length, a thread drawing nozzle for sucking the thread chain having been tacked idly to a predetermined length in the thread chain cutter, a thread chain clamp cylinder for urging and securing the thread chain after it has been sucked into the thread drawing nozzle, a nozzle swing cylinder operative in response to a machine stop signal to cause rocking of the thread drawing nozzle between an advanced position nearer a needle drop position and a retreated position, a nozzle pulling cylinder for setting a substantially middle position of the thread drawing nozzle between the advanced and retreated positions, a position adjust means for adjusting the advanced or retreated position of the thread drawing nozzle, a speed setting/releasing unit for maintaining the needle operation cycle number and machine rotation number and releasing the pressure on the thread clamp provided in the thread clamp cylinder after a predetermined number of needle operation cycles, a venturi unit for converting the pressure in tubes coupled to the thread chain cutter and thread drawing nozzle, respectively, from positive to negative pressure, and air blow-back means for causing blow-back of air to the thread chain cutter by blocking the air flow path from the venturi unit, said presser foot having a presser foot stitch tongue secured to a presser body, said presser foot stitch tongue having a back surface formed with a groove for stabilizing the thread chain at the back-tacking position and a top guide portion for guiding the thread chain to said back surface groove.

Since the presser foot stitch tongue is secured to a central portion of the presser body of the presser foot with its back surface formed with a groove for holding the thread chain stably at the back-tacking position, and since the presser foot stitch tongue also has a top guide for guiding the thread chain into the groove in the back surface, the thread chain at the time of back-tacking is led along the guide of the presser foot stitch tongue into the back surface groove to be guided by the back surface of the presser foot. Thus, it is possible to obtain back-tacking of the thread chain without contact with the upper looper yarn. It is thus possible to prevent loosening of tension in the upper looper yarn and obtain satisfactory back-tacking results.

DETAILED DESCRIPTION OF THE PREFERRED EMBODIMENT

Figure 7:
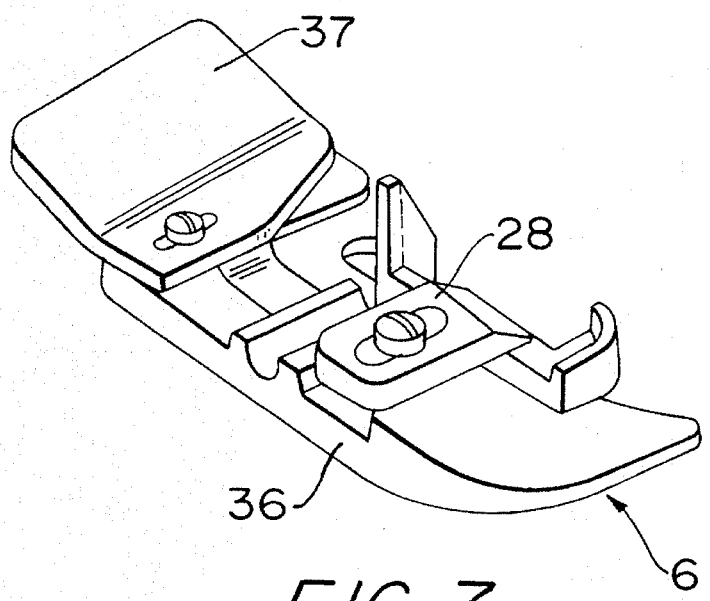
FIGS. 7 to 10 are views showing a presser foot with a presser foot stitch tongue secured thereto.
Figure 8:
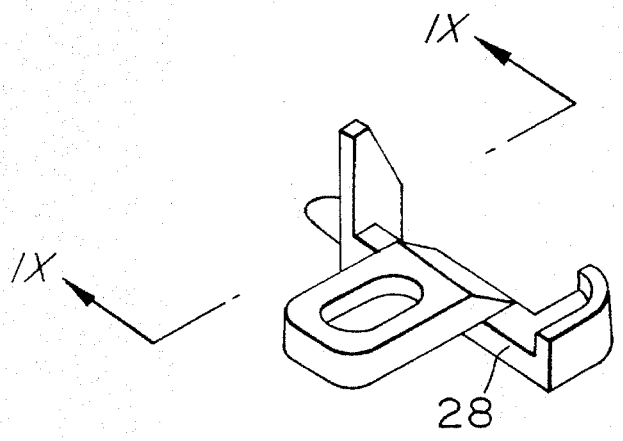
Figure 9:
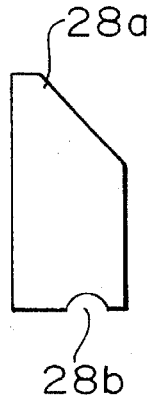

FIG. 7 is a perspective view showing a typical presser foot used in accordance with the present invention. The illustrated presser foot 6 comprises a presser body 36, a presser foot chain shield 37 secured to the rear end of the presser body, and a presser foot stitch tongue 28 secured to a central portion of the presser body. FIG. 8 is a perspective view showing the presser foot stitch tongue 28. FIG. 9 is a sectional view taken along line IX—IX in FIG. 8.

Figure 10:
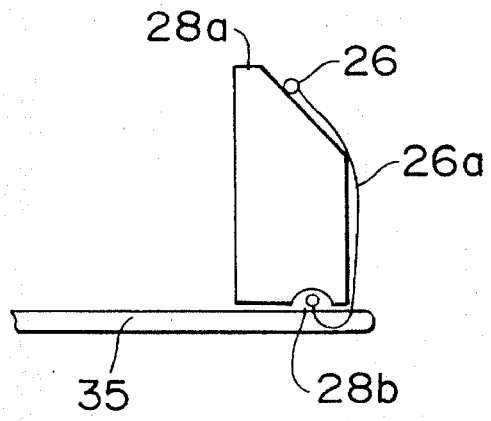

As shown in FIG. 9, the presser foot stitch tongue 28 has a groove 28*b* formed in its back surface and also an inclined top surface serving as a thread chain guide 28*a*. In an overlock sewing machine having the presser foot 6 and presser foot stitch tongue 28 according to the present invention, the thread chain 26, which is pulled in the direction opposite to the back-tacking direction by a thread drawing unit as shown in FIG. 10, for instance, slips down along the inclined surface of the thread chain guide 28*a* of the presser foot stitch tongue 28, following an orbit 26*a* to enter and be guided along the groove 28*b* to be back-tacked to the start end of cloth 35 without contacting the upper looper thread.

A presser foot chain shield 37 is provided to prevent the thread chain from occasionally being wound about the presser foot 6 during a long back-tacking operation. See FIG. 7.

Now, the present invention will be described in further detail with reference to the accompanying drawings.

Figure 1:
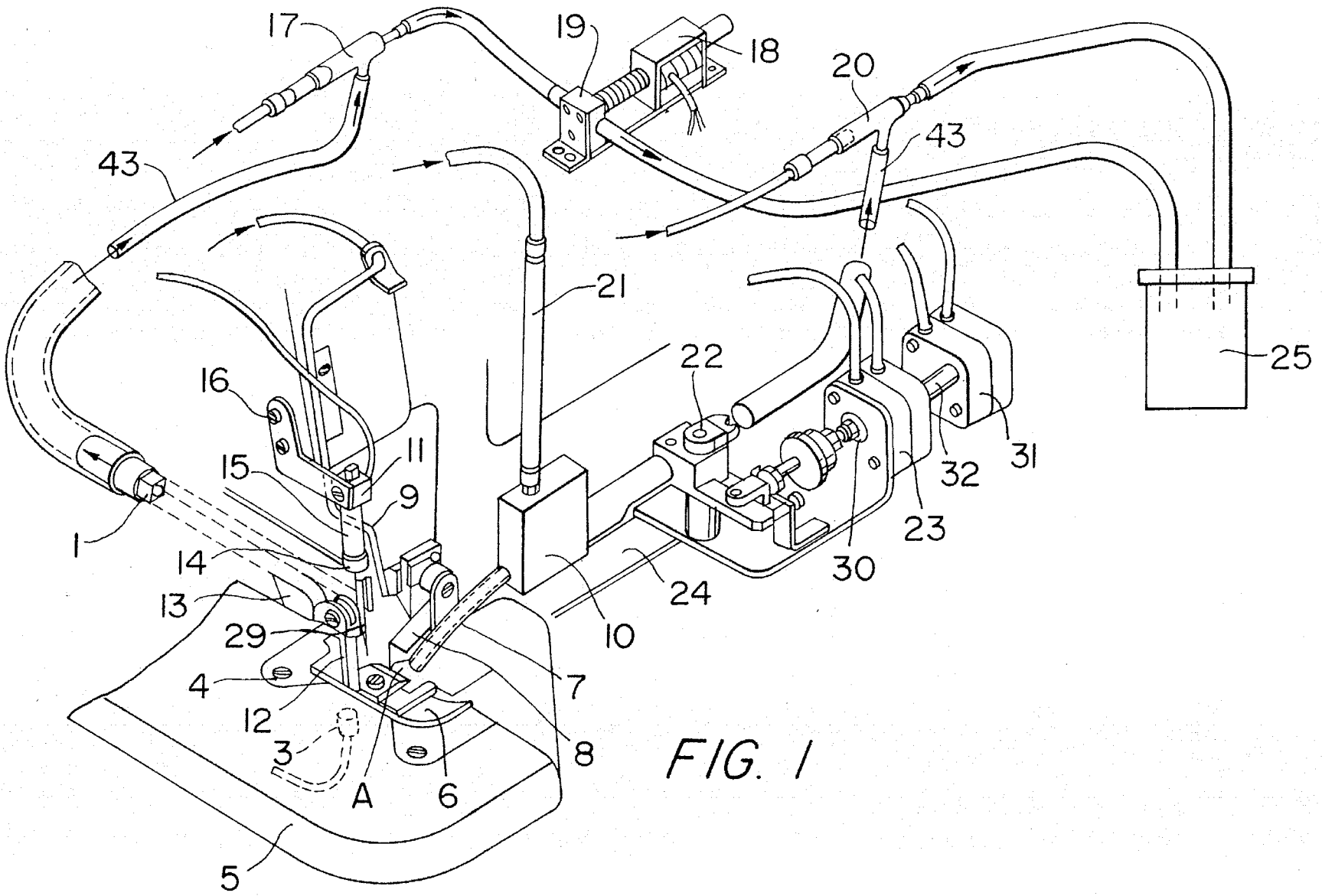
FIG. 1 is a perspective view showing an embodiment of the invention.

FIG. 1 is a view showing an embodiment of the thread chain back-tacker for an overlock sewing machine according to the present invention, and FIGS. 2 to 6 are views showing parts shown in FIG. 1 in detail.

The illustrated thread chain back-tacker comprises a thread chain cutter 1 provided in an overlock sewing machine body 24; an adjuster for adjusting the length of free thread chain surplus after the end of back-tacking, which includes a light receiver 3 and a light projector 11 disposed above the light receiver 3 for projecting light thereon and detecting cloth, if any, according to whether the light receiver 3 is bright or dark; a presser foot 6, which stably leads the thread chain 26 to a back-tacking position while feeding cloth in cooperation with a feed dog (not shown); a thread drawing nozzle 7 for sucking the thread chain 26 that has been tacked idly to a predetermined length in the thread chain cutter; a thread clamp cylinder 21 including a thread clamp 27 (see FIG. 3) for urging and securing the thread chain sucked into the thread drawing nozzle; and a front air nozzle 9. When the thread chain held pressed and secured in a thread clamp cylinder holder 10 by a thread clamp cylinder 21 has been tacked in cloth 35 at a subsequent position a predetermined length from the start of sewing, and, after release of pressure, is further tacked in correspondence to the amount of operation of a back-tacking length counter, the front air nozzle 9 blows air against the thread chain 26 to lead the thread chain 26 to a knife assembly of the sewing machine body 24. The knife assembly includes an upper knife 8 for cutting the thread chain 26 to the predetermined length, thus setting the back-tacking length.

The back-tacker further includes a nozzle swing cylinder 23, which is operative in response to a machine stop signal to cause rocking of the thread drawing nozzle 7 via a rod 30 and a shaft 22 between an advanced position nearer a needle drop position and a retreated position nearer the operator; a nozzle pulling cylinder 31 for setting a substantially middle position of the thread drawing nozzle between the advanced and retreated positions thereof; a cylinder retainer 32 coupling together the nozzle swing cylinder 23 and nozzle pulling cylinder 31; a position adjuster bolt 33 (see FIG. 4), which is provided on the cylinder retainer 32 for adjusting the advanced or retreated position of the thread drawing nozzle 7; a speed setting/releasing unit for maintaining the number of needle operation cycles and rotation speed of the machine during back-tacking of the thread chain, and for releasing the pressure on the thread clamp provided in the thread clamp holder after a predetermined number of needle operation cycles; venturis 17 and 20 for converting air pressure in vinyl tubes 43 coupled to the thread chain cutter 1 and thread drawing nozzle 7, respectively, from positive to negative pressure; an air breaking valve 19 for causing blow-back of air to the thread chain cutter 1 by blocking the air flow path from the venturi 17; and an air breaking solenoid 18 for on-off operating the air breaking valve 19.

Figure 2A:
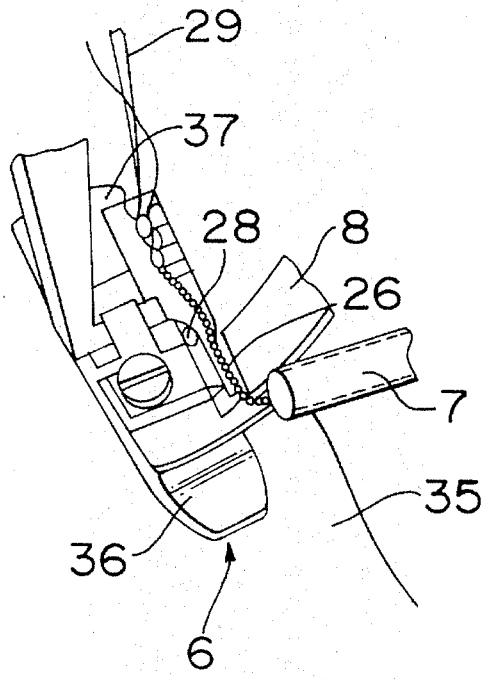
FIGS. 2(*a*)–2(*b*) are enlarged scale fragmentary perspective views illustrating the back-tacking of a thread chain using a presser foot stitch tongue.
Figure 2B:
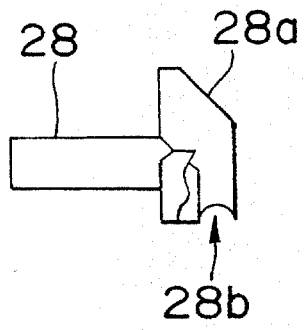
Figure 3:
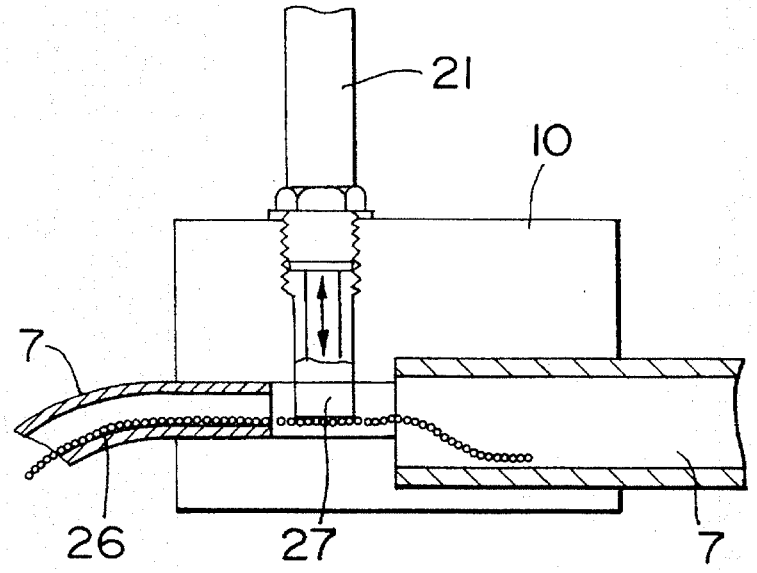
FIG. 3 is a sectional view showing a thread clamp cylinder holder, with the thread chain being shown urged by a thread clamp.
Figure 4:
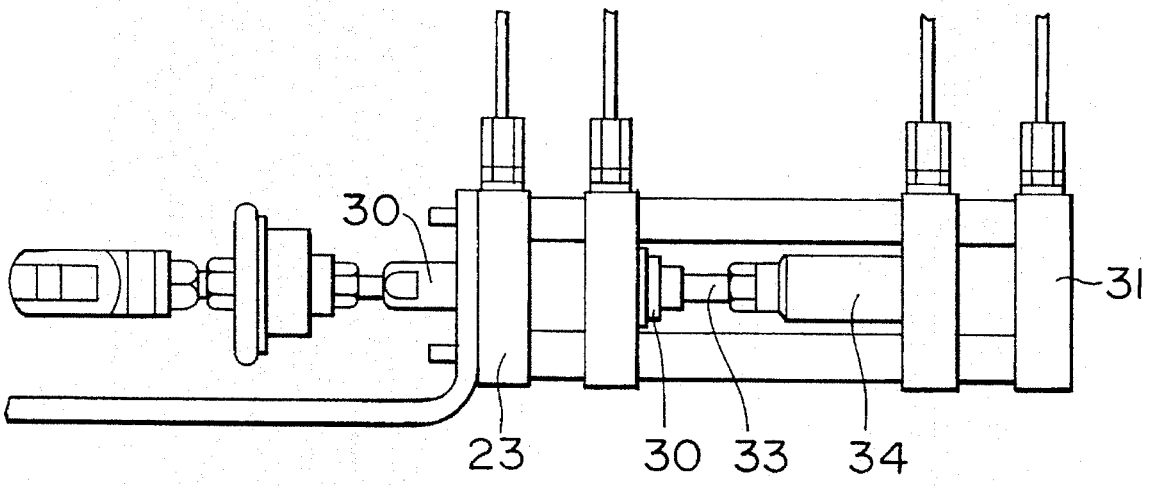
FIG. 4 is a view showing a state in which a thread drawing nozzle has been brought back to an intermediate position (second position) after sucking the thread chain.
Figure 5:
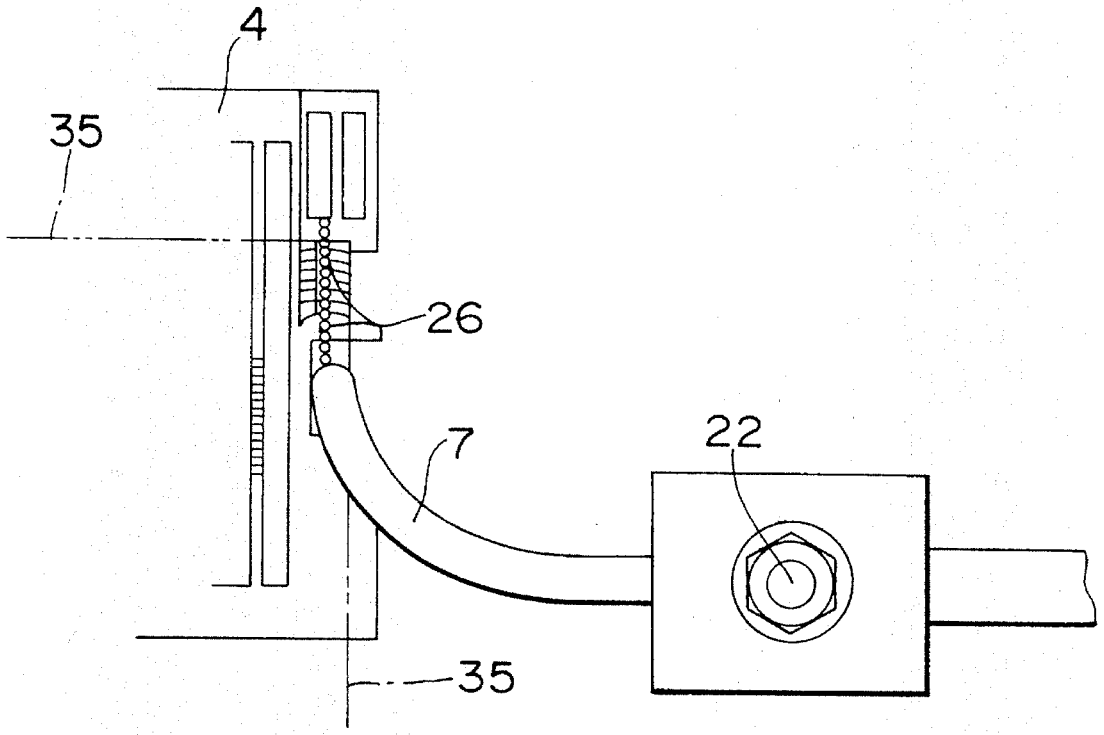
FIG. 5 is a view showing a state in which a cloth is at the pawl tip of a stitch plate.

The presser foot 6 comprises a presser body 36, a presser foot chain shield 37 secured to the rear end of the presser body, and a presser foot stitch tongue 28 secured to a central portion of the presser body (see FIGS. 2(*a*)–2(*b*)). The presser foot stitch tongue 28 has a thread chain guide 28*a* and a groove 28*b*.

Returning to FIG. 1, designated at 4 is a stitch plate, at 5 a cloth plate, at 10 the thread clamp cylinder holder which couples together the thread drawing nozzle 7 and thread clamp cylinder 21, at 12 a presser foot hinge for urging the presser foot 6, at 13 a presser arm supporting the presser foot hinge, at 15 a needle bar, at 14 a needle clamp for securing a back-tacking needle 29 to the needle bar 15, at 8 the upper knife, which cooperates with a lower knife (not shown) to cut the thread chain 26 and cloth end, at 16 a light projector holder, to which the light projector 11 is secured, and at 25 a dust collection box coupled to the venturi 20 and air breaking valve 19 via respective vinyl tubes.

Figure 11:
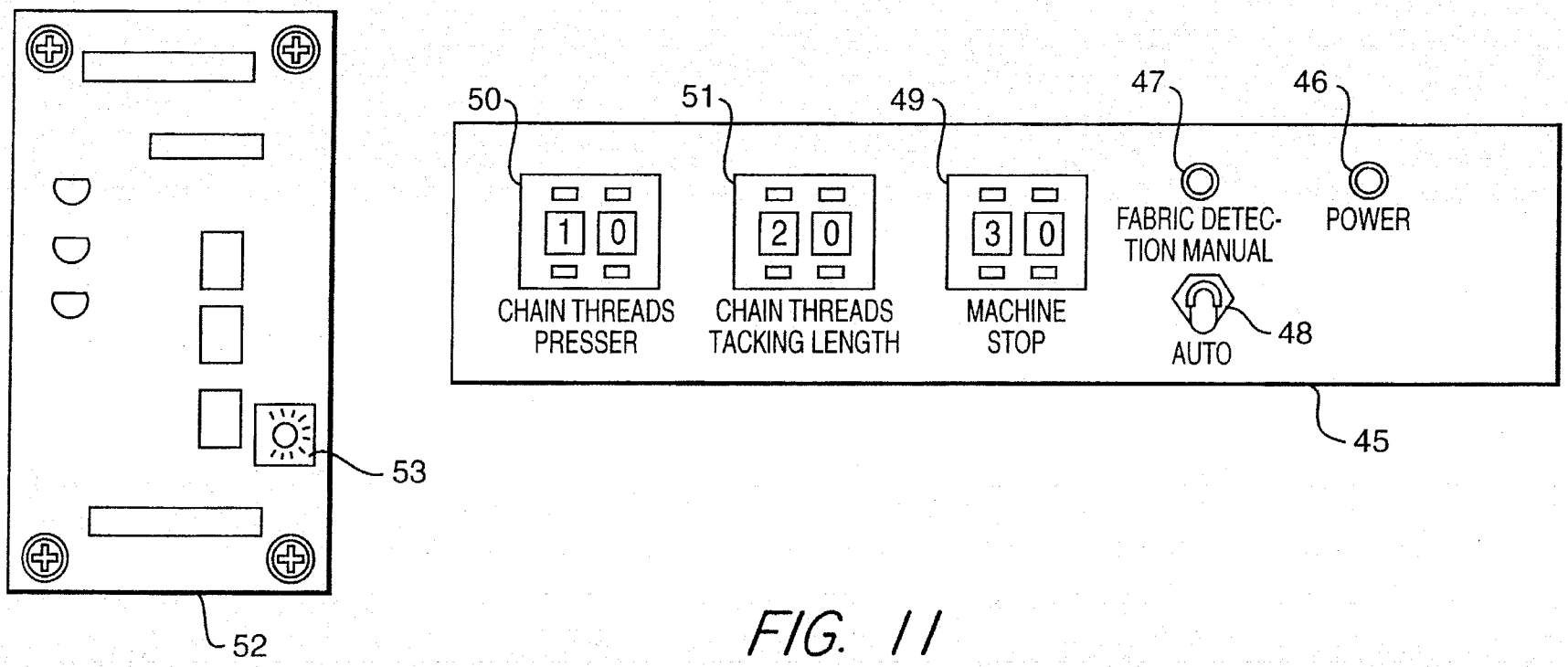
FIGS. 11(*a*) and 11(*b*) are respective views showing a control panel for controlling an embodiment of an overlock sewing machine, and an interface board, constructed according to the invention.

FIGS. 11(*a*) and 11(*b*) are respective views showing a control panel for controlling the machine and an interface board provided in the control panel. Referring to the Figure, the control panel 45 has a power source pilot lamp 46, a cloth detection lamp 47, an auto/manual switch 48, a machine stop counter 49, a thread clamp counter 50, and a back-tacking length counter 51.

The power source pilot lamp 46 shows the "on" or "off" state of the power source. The cloth detection lamp 47 is turned off when it detects the cloth to be tacked. The auto/manual switch 48 selects or releases an automatic back-tacking state. The machine stop counter 49 adjusts the length of thread chain surplus after the end of back-tacking. The thread clamp counter 50 sets the number of constant rate needle operation cycles of the machine at the start of back-tacking of the thread chain. After the set number of needle operation cycles, that is, after the thread chain has been tacked to a predetermined length, a thread clamp 27 provided in the thread chain clamp cylinder 21 releases the pressure of the thread chain. The back-tacking length counter 51 sets the number of needle operation cycles until air is blown out from the air nozzle 9 after the thread chain has been tacked to the predetermined length. By the air blown out from the air nozzle, the thread chain is led to the knife assembly of the machine body 24 including the upper knife 8, to be cut to a predetermined length. In this way, the back-tacking length of the thread chain is determined.

The interface board 52 has a variable resistor 53. The thread clamp counter 50 and the variable resistor 53 are main components of a speed setting/releasing unit. The speed setting/releasing unit serves to hold the number of needle operation cycles and the speed of rotation of the machine constant during the back-tacking operation. The speed setting/releasing unit releases the pressure of the thread clamp 27 of the thread clamp cylinder 21 after the thread chain has been tacked to a predetermined length.

Figure 12:
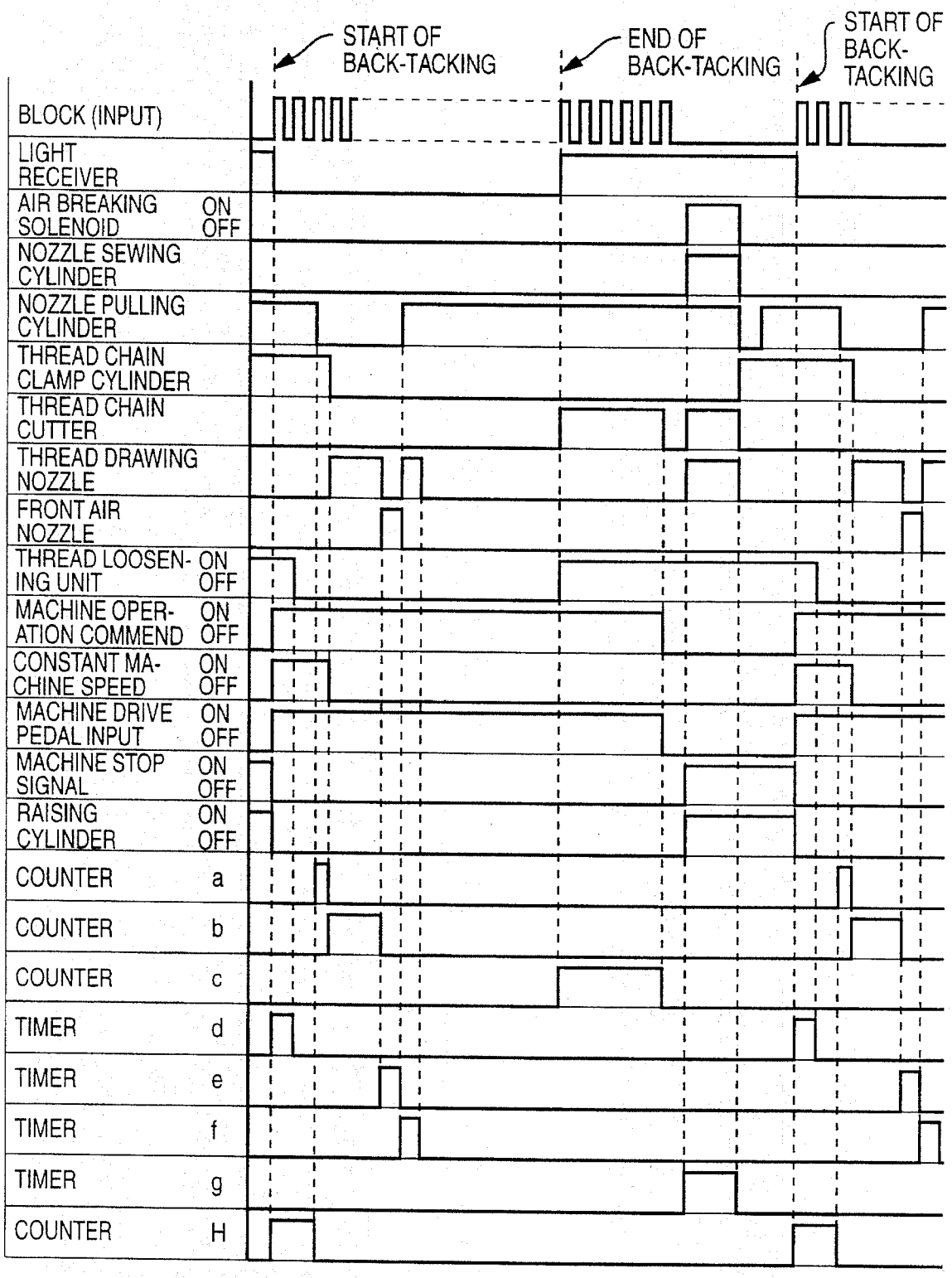
FIG. 12 is a timing chart illustrating the operation of the invention.

The operation of the thread chain back-tacker having the above construction will now be described with reference to the timing chart of FIG. 12.

When back-tacking to the cloth at the former position thereof is ended, the light receiver 3 becomes bright from dark, and the thread chain cutter 1 starts suction. Also, a thread loosening unit (not shown) loosens the thread chain 26 from ground tacking. As a result, the machine motor is rotated up to a speed indicated by a counter C for adjusting the length of the thread chain 26 at the end of back-tacking to a predetermined length.

Subsequently, the thread chain is tacked idly to a predetermined length. When the thread chain 26 is tacked idly to the predetermined length, the machine motor is stopped, and also the suction of the thread chain cutter 1 is stopped. Then, a rod of nozzle swing cylinder 23 is caused to be advanced (see FIG. 4) by receiving a machine stop signal. The thread drawing nozzle 7 is thus caused to rock about the shaft 22, and the nozzle end of the thread drawing nozzle 7 is brought to the vicinity of a needle drop position (first position).

At the same time, the suction of the thread drawing nozzle 7 is started. Then, timer g is rendered operative. Air breaking solenoid 18 is held energized for a predetermined period of time as set by the timer g. Air in the tube is thus caused to flow reversely to the thread chain cutter 1 through the air breaking valve 19, and thus the thread chain 26 is readily sucked into the thread drawing nozzle 7.

Then, after a lapse of the predetermined time of the timer g, the air breaking solenoid 18 is turned off to cause retreat of the nozzle swing cylinder 23 and nozzle pulling cylinder 31. The nozzle end of the thread drawing nozzle 7 is thus retreated to the front end of the rocking range (third position) (see FIG. 6). Simultaneously with the start of retreat of the nozzle swing cylinder 23 and nozzle pulling cylinder 31, the thread clamp cylinder 21 and a raising cylinder (not shown) are caused to start operation. The thread clamp 27 is thus caused to fall, urging and securing the thread chain 26 (see FIG. 3).

At this time, the presser foot 6 is raised, and the thread chain 26 is caused to slide over the inclined surface of the thread chain guide 28*a* of the presser foot stitch tongue 28 coupled to the presser foot 6 to enter the groove 28*b* formed in the back surface of the presser foot stitch tongue 28. Then, the nozzle pulling cylinder 31 is advanced to move the nozzle end of the thread drawing nozzle 7 to the vicinity of the upper knife 8 (second position) (see FIG. 5).

At this time, the next position cloth 35 is inserted between the presser foot 6 and stitch plate top surface 4 such that the end of the cloth reaches portion A of the upper knife 8. With the insertion of the cloth 35 between the presser foot 6 and stitch plate 4, the light receiver 3 becomes dark from bright. After a lapse of time of the timer d, the thread loosening unit, which has been continuing thread loosening, releases the thread loosening operation, thus bringing about a normal back-tacking state.

Figure 6:
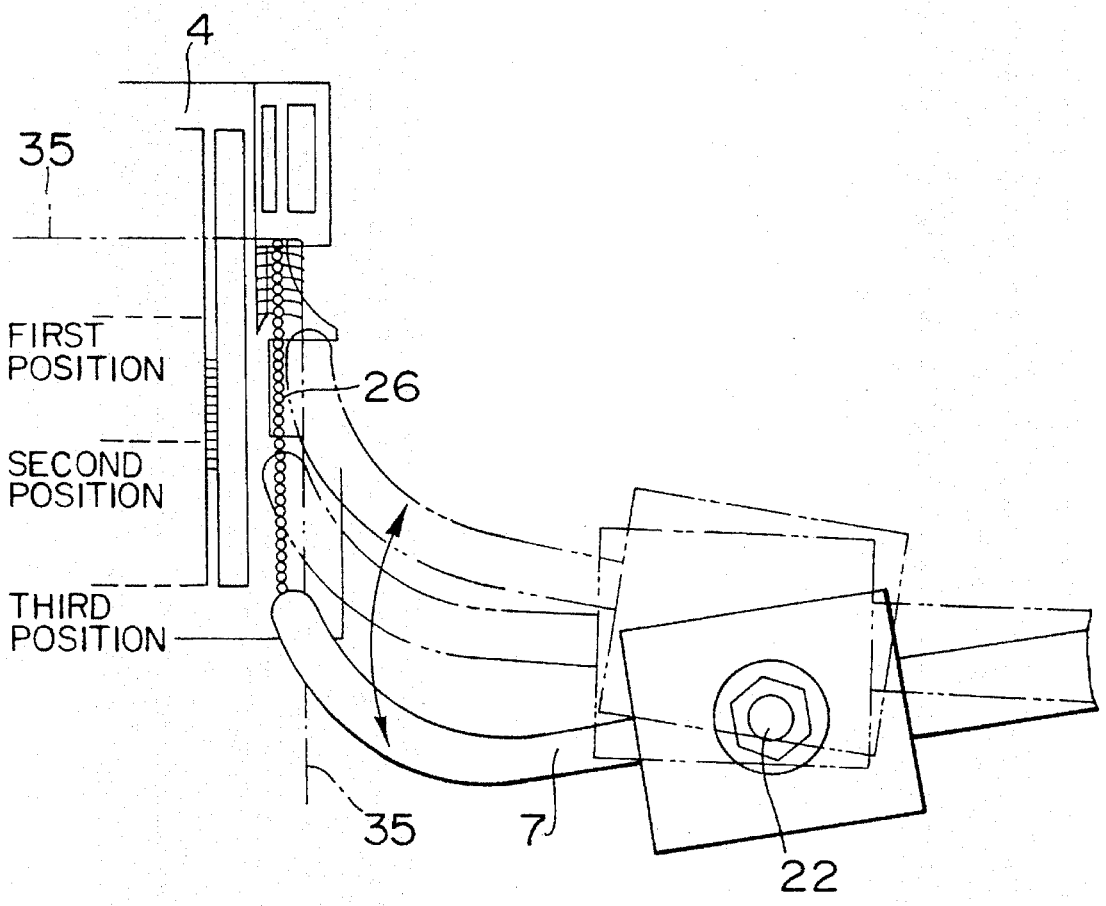
FIG. 6 is a view showing a state in which a thread chain is drawing into a seam.

By subsequently depressing a machine drive pedal, the operator causes the machine to execute constant speed rotation, and after a predetermined count H, the nozzle pulling cylinder 31 is retreated once again. The thread drawing nozzle 7 is thus retreated to the third position as shown in FIG. 6, pulling the thread chain at the back-tacking start position of the cloth to the seam. Then, as soon as the count a is completed, the thread clamp cylinder 21 is raised, and the thread clamp 27 releases the thread chain 26. Subsequently, after the end of the count b, the front air nozzle 9 blows against the thread chain 26 to hold the thread chain against the knife assembly of machine body 24, including the upper knife 8, for the period of the timer 3. Thus, the thread chain 26 is cut. After the time-up of the timer e, the venturi 20 is rendered operative for the time of the timer f, thus feeding suction air to the thread drawing nozzle 7 and moving the remaining thread chain 26 to the suction dust collection box 25, bringing an end to the back-tacking of the thread chain 26.

In this embodiment, since the presser foot stitch tongue 28 secured to the presser foot 6 has the thread chain guide 28*a* provided at the top and also has the groove 28*b* formed in the back surface, the thread chain 26 can slide over the inclined surface of the thread chain guide 28*a* to eventually enter the groove 28*b* in the back surface of the presser foot stitch tongue. It is thus possible to prevent trouble due to catching of the thread chain 26 by the upper looper thread, for instance the loosening of the upper looper thread tension. Instead, satisfactory back-tacking results are achieved from the outset.

Further, in this embodiment with the thread chain 26 held urged and secured by the thread clamp cylinder 21, the nozzle end of the thread drawing nozzle 7 is retreated to the third position, and the thread chain is pulled into the seam in a state supported by the groove 28*b* in the back surface of the presser foot stitch tongue 28. It is thus possible to prevent lateral rock of the thread chain 26, thus preventing trouble due to contact of the thread chain 26 with needle 29, for instance breakage thereof.

Now, the back-tacking operation of a machine according to the invention will be compared to the prior art, for instance Japanese patent application laid-open No. Sho 61-45797 (Pegasus). According to this prior art, the thread chain is held by the surface of a presser foot stitch tongue provided on a presser foot. In contrast, in the machine according to the invention, the thread chain is supported in a groove formed in the back surface of the presser foot stitch tongue.

Figure 13A:
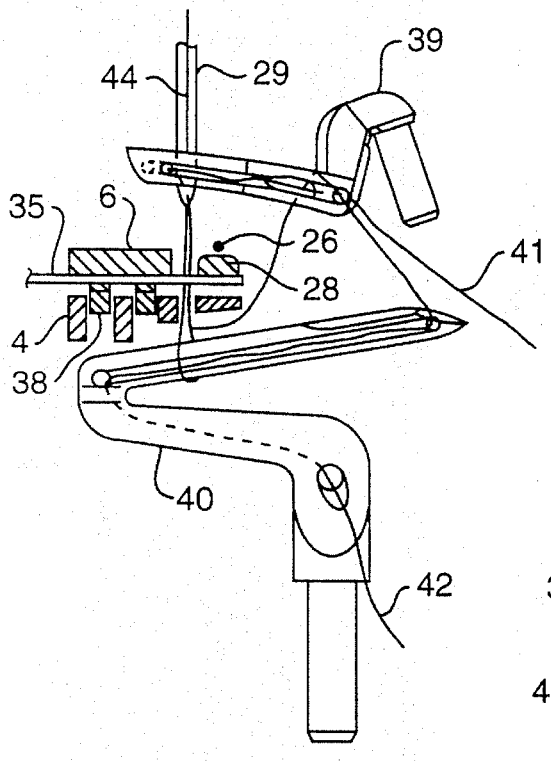
FIG. 13(a) PRIOR ART
FIGS. 13(*a*) to 13(*c*) are views showing a needle drop position in the prior art.
Figure 13B:
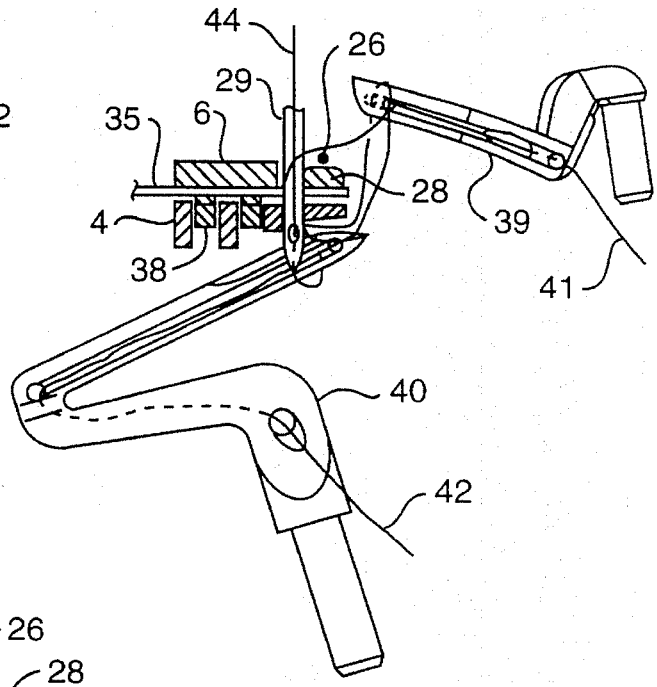
FIG. 13(b) PRIOR ART
Figure 13C:
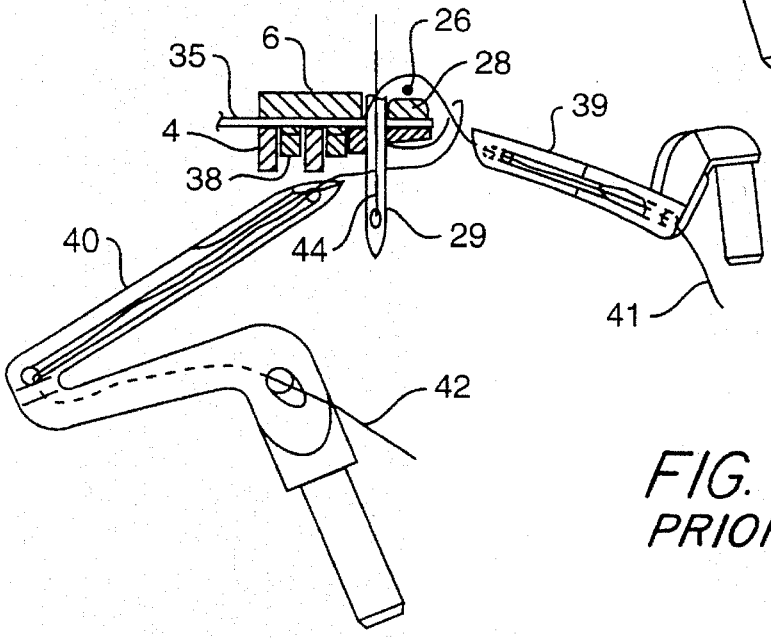
FIG. 13(c) PRIOR ART

FIGS. 13(*a*) to 13(*c*) are sectional views shown a needle drop position in the prior art. The Figures show a stitch plate 4, cloth 35 put on the stitch plate 4, a presser foot 6 for pressing the cloth 35 downward, a feed dog 38 for feeding the cloth 35 in the tacking direction in cooperation with the presser foot 6, a presser foot stitch tongue 28 provided on the presser foot 6, a needle 29, and an upper looper 39 and a lower looper 40 which are moved in an interlocked relation to the needle 29. Designated at 26 is a thread chain, at 41 an upper looper thread, at 42 a lower looper thread, and at 44 a tacking thread.

With this arrangement, as shown in FIGS. 13(*a*) to 13(*c*), the thread chain 26 is tacked into the tacking start end of cloth 35 which is fed by feed dog 38 into the plane of the Figure. More specifically, the needle 29 is moved vertically, and this movement produces a predetermined movement of the upper and lower loopers 39 and 40. Three-thread stitches of the thread 44 and upper and lower looper threads 41 and 42 are thus formed by the single needle, with the thread chain 26 tacked into the tacking start end of the cloth 35. At this time, as shown in FIGS. 13(*b*) and 13(*c*), the thread chain 26 is brought into direct contact with the upper looper thread 41. As a result of resistance due to the contact, the upper looper thread 41 is not tacked in correspondence to the tension, which results in defective tacking. That is, it is impossible to obtain back-tacking of a good character.

According to Pegasus, the presser foot stitch tongue 28 has a groove for the thread chain, but the groove is formed in a front surface of the presser foot stitch tongue 28. This groove has a role of accurately leading the thread chain 26 to the needle drop position. That is, it does not serve to prevent the contact of the thread chain 26 and the upper looper thread with each other. Therefore, the thread chain 26 is exposed at the needle drop position, thus resulting in direct contact of the thread chain 26 and the upper looper thread 41. The contact produces friction, thus leading to defective tacking of the upper looper thread.

Figure 14A:
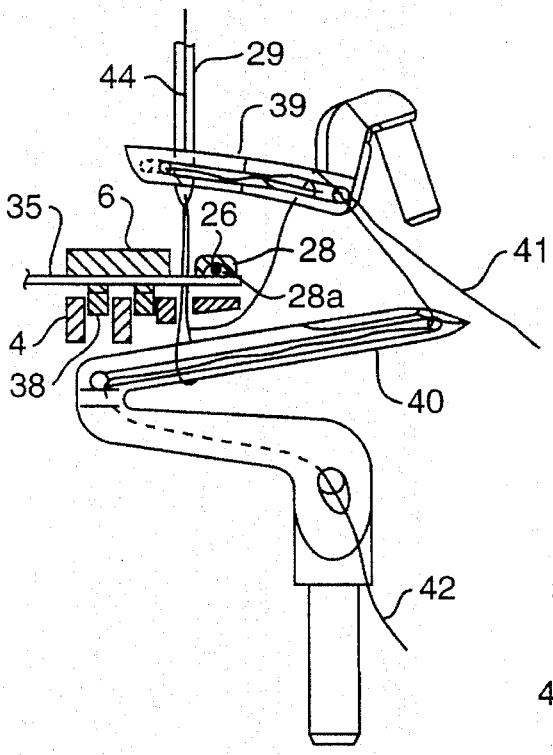
FIGS. 14(*a*) to 14(*c*) are views showing a needle drop position in an embodiment of a machine constructed according to the invention.
Figure 14B:
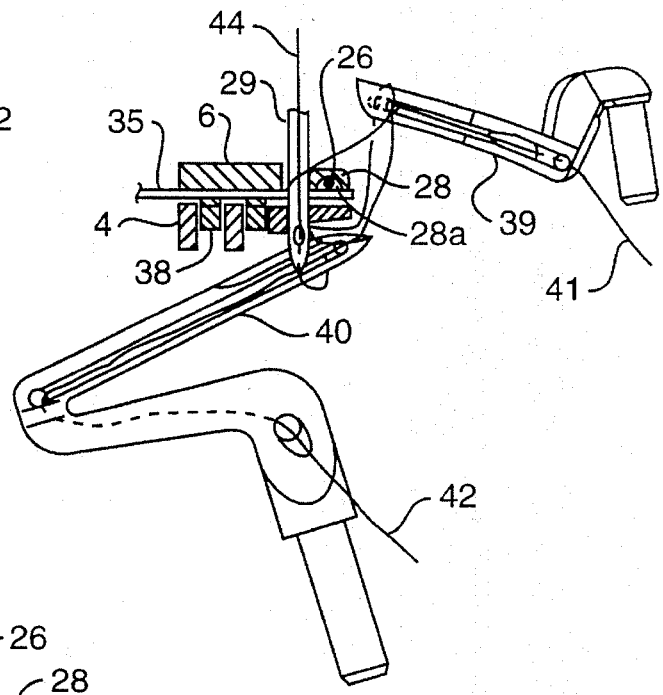
Figure 14C:
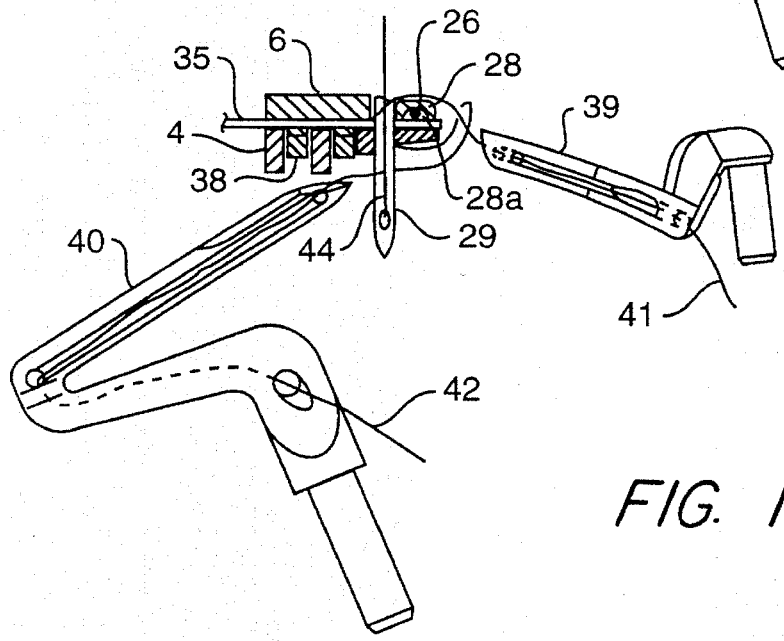

FIGS. 14(*a*) to 14(*c*) are sectional views showing the needle drop position in the machine according to the invention. Referring to the Figures, the presser foot stitch tongue 28 has a groove 28*b* formed in its back surface. At the needle drop position, the thread chain 26 is engaged in the groove 28*b* of the presser foot stitch tongue 28. The thread chain 26 is not exposed in the needle drop position. Thus, it does not touch the upper looper thread 41 during the back-tacking operation. Accordingly, with the machine according to the invention, unlike the prior art, the upper looper thread tension is not loosened. It is thus possible with the inventive machine to obtain back-tacking of good character because of the freedom from loosening of the upper looper thread tension. Further, the thread chain 26 does not project from the stacking start end of cloth 35, nor is the end of cloth 35 curled.

As has been shown, according to the present invention with the thread chain guide and thread chain groove respectively provided on top and in the back surface of the presser foot stitch tongue secured to the presser foot, the thread chain can be guided by the back surface of the presser foot. Thus, it is possible to eliminate not only curling of the cloth but also projection of the thread chain, thus preventing the loosening of tension in the upper looper thread due to contact between the thread chain and upper looper thread.

What we claim is:

1. A thread chain back-tacker for an overlock sewing machine for back-tacking a thread chain to a cloth, comprising:

a presser foot for pressing a cloth to be tacked;

a front air nozzle disposed above said presser foot, for blowing air against a surplus of a back-tacked thread chain to set a back-tacking length of the thread chain surplus;

an adjuster for adjusting the length of the thread chain surplus after the thread chain has been back-tacked;

a thread drawing nozzle for sucking an end of the thread chain surplus after the thread chain has been idly tacked to the cloth;

a thread clamp cylinder having a thread clamp for urging and securing the thread chain surplus after the thread chain surplus has been sucked into said thread drawing nozzle;

a nozzle swing cylinder operative in response to a machine stop signal to cause rocking of said thread drawing nozzle between an advanced position and a retreated position, said advanced position being nearer than said retreated position to a needle drop position of the overlock sewing machine;

a nozzle pulling cylinder for setting a substantially middle position of said thread drawing nozzle between the advanced and retreated positions;

a speed setting/releasing unit for maintaining the number of needle operation cycles and rotation speed of the machine during back-tacking of the thread chain, and for releasing the pressure on said thread clamp provided in said thread clamp cylinder after a predetermined number of needle operation cycles; and a venturi unit for converting the pressure in a tube coupled to said thread drawing nozzle from positive pressure to negative pressure;

wherein said presser foot includes means for preventing the thread chain at the back-tacking position from contacting an upper looper thread when tacking the thread chain to the cloth.

2. A thread chain back-tacker according to claim 1, wherein said means for preventing contact between the thread chain and the upper looper thread is a presser foot stitch tongue secured to a presser body of the presser foot, wherein said presser foot stitch tongue has a back surface formed with a groove for stabilizing the thread chain at the back-tacking position.

3. A thread chain back-tacker according to claim 2, wherein said presser foot has a presser foot chain shield for preventing the thread chain from occasionally being wound about the presser foot during long back-tacking operations.

* * * * *